United States Patent [19]

Shima

[11] 4,409,801

[45] Oct. 18, 1983

[54] NEEDLE SELECTING METHOD AND APPARATUS IN FLAT KNITTING MACHINE

[75] Inventor: Masahiro Shima, Wakayamashi, Japan

[73] Assignee: Shima Idea Center Co., Inc., Japan

[21] Appl. No.: 269,046

[22] PCT Filed: Sep. 28, 1979

[86] PCT No.: PCT/JP79/00248

§ 371 Date: May 28, 1981

§ 102(e) Date: May 28, 1981

[87] PCT Pub. No.: WO81/00869

PCT Pub. Date: Apr. 2, 1981

[51] Int. Cl.[3] ..... D04B 7/00

[52] U.S. Cl. ..... 66/75.1; 66/78

[58] Field of Search ..... 66/75.1, 64, 75.2, 215, 66/78, 70

[56] References Cited

U.S. PATENT DOCUMENTS 3,693,377 9/1972 Hadham ..... 60/75.2

FOREIGN PATENT DOCUMENTS 2842054 3/1979 Fed. Rep. of Germany ..... 66/75.2

*Primary Examiner*—Ronald Feldbaum

*Attorney, Agent, or Firm*—Barnes, Kisselle, Raisch, Choate, Whittemore & Hulbert

[57] ABSTRACT

The present invention relates to a needle selecting method and needle selecting apparatus in a flat knitting machine. For electrically selecting the three needle positions, that is, the knit, tuck and welt positions, by using an electromagnet, needle selecting members are arranged on both the sides of one lock mounted on a carriage. Preliminary selection of needles is carried out by the needle selecting member located on the rear side of the direction of advance of the carriage to divide the needles into two groups, and at the time of reversion of the moving direction of the carriage, needles of one group of said two preliminarily selected groups are selected and divided into another two groups by the needle selecting member, whereby the above-mentioned three positions are selected for the needles.

13 Claims, 3 Drawing Figures

NEEDLE SELECTING METHOD AND APPARATUS IN FLAT KNITTING MACHINE

DESCRIPTION

1. Technical Field

The present invention relates to a needle selecting method and apparatus in a flat knitting machine. More particularly, the present invention relates to a needle selecting method and apparatus in which three positions of needles, that is, knit, tuck and welt positions, are selected by needle operations including electric operations in forming knitted fabrics.

2. Background Art

In a flat knitting machine, when needles are electrically selected, an electromagnet or the like is used and by putting on and off the electromagnet or the like, movements of the electromagnet or the like are appropriately transmitted to needles to control movements of the needles. According to this operation, however, the needles are selected and divided only in two groups. There also is known a needle selecting method in which an electric needle preselecting system is combined with a lock. However, in this method, since one preselecting system is provided for one lock, a knitting operation cannot be performed at a high efficiency, and the stroke of a carriage is large.

In a flat knitting machine, there is adopted a needle selecting method in which in selecting the knit, tuck and welt positions for needles by mechanical means, a prism is used to divide needles into needles at the welt position and needles at the other position and needles at the position other than the welt position are further divided into needles at the tuck position and needles at the knit position.

In this method, the butt height of needles to be located at the tuck position is made different from the butt height of needles to be located at the knit position, and the needles should be divided into high needles and low needles. Accordingly, in this method, the kinds of needles are restricted and patterns cannot freely be selected, and when patterns are changed, also the kinds of needles should be changed.

DISCLOSURE OF INVENTION

In the apparatus of the present invention, needle selecting members are disposed on both the sides of one lock on a carriage.

According to the method of the present invention, needles which have already performed the knitting operation are preliminarily selected and divided into two groups by a needle selecting member located on the rear side in the direction of advance of a carriage, and at the time of subsequent reversion of the movement of the carriage, needles of one group of the two groups divided by said preliminary selection are further selected and divided into two groups by a needle selecting member located on the front side in the direction of advance of the carriage, whereby the three positions are selected for the needles.

By virtue of the above characteristic feature, according to the present invention, selection of the three positions for needles can be accomplished by one lock and needle selecting members located on both the sides of the lock, and preliminary needle selection and secondary needle selection can be performed during one stroke of the carriage. Moreover, the width of the movement of the carriage to the knitting width can be reduced.

Furthermore, needles need not be changed when patterns are changed, and arrangement of patterns can freely be made.

BEST MODE FOR CARRYING OUT THE INVENTION

Figure 1:
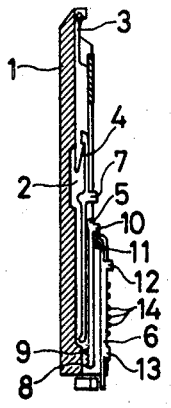
FIG. 1 is a longitudinally sectional, side view showing a needle bed.

FIG. 1 shows the section of a needle bed. Reference numeral 1 represents a needle bed, and needles 3, jacks 4, select jacks 5 and selectors 6 are slidably fitted in needle grooves 2 formed on the needle bed 1 and arranged at equal intervals in parallel to each other. The bent top portion of the jack 4 is fitted in a recessed portion of the needle 3 so that the jack 4 and needle 3 can slide integrally. Reference numeral 7 represents a jack butt. The select jack 5 has on the lower end thereof, as shown in FIG. 1, concave portions 8 spaced from one another at intervals corresponding to the knit, tuck and welt positions of the needles. The concave portions 8 are adapted to be engaged with a pin 9 disposed on the needle bed 1 to extend in the longitudinal direction of the needle bed 1 so that the position of a select jack is not randomly shifted. Reference numeral 10 represents a select jack butt, and reference numeral 11 represents a pin for preventing the select jack from falling out. The selector 6 is located so that the top end of the selector 6 butts against the select jack butt 10. Reference numerals 12, 13 and 14 represent selector butts.

In this embodiment, the selector butt 14 located between the selector butts 12 and 13 can take 6 positions among which the selector butt 14 is shifted, and 6 kinds of selectors 6 are prepared and used.

Figure 2:
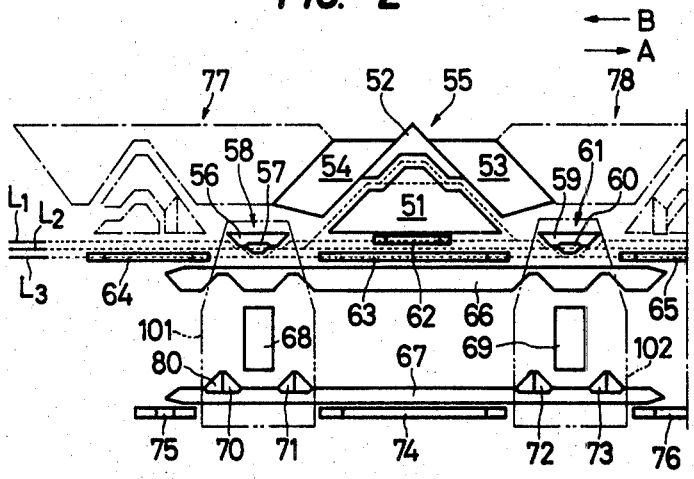
FIG. 2 is a plan view of the cam arrangement of a one-lock carriage, seen through a ground plate for cams.

FIG. 2 shows the cam arrangement in a carriage having one lock.

A lock 55 is comprising a clearing cam 51, a guard cam 52 located above the clearing cam 51 and knitting cams 53 and 54 disposed on both the sides of the clearing cam 51. A select jack lowering cam 58 including a stationary cam 56 and a movable cam 57 and a select jack lowering cam 61 including a stationary cam 59 and a movable cam 60 are arranged on both the left and right sides of the lock 55. Reference numerals 62, 63, 64 and 65 represent select jack pressure cams, and reference numerals 66 and 67 represent selector guide cams. Needle selecting actuators 68 and 69 are arranged between the selector guide cams 66 and 67 below the select jack lowering cams 58 and 61. According to electric signals from a memory device (not shown), both the needle selecting actuators 68 and 69 butt against the butt 14 of the selector 6 to selectively elevate the selector 6. On the selector guide cam 67, selector push-up cams 70, 71, 72 and 73 are disposed below the needle selecting actuators 68 and 69 with the actuators 68 and 69 therebetween. A set of needle selecting members 101 is constructed by the select jack lowering cam 58, needle selecting actuator 68 and selector push-up cams 70 and 72, and another set of needle selecting members 102 is constructed by the select jack lowering cam 61, needle selecting actuator 69 and selector push-up cams 72 and 73. Reference numerals 74, 75 and 76 represent selector lifting cams and reference numerals 77 and 78 represent stitch transfer cams.

Figure 3:
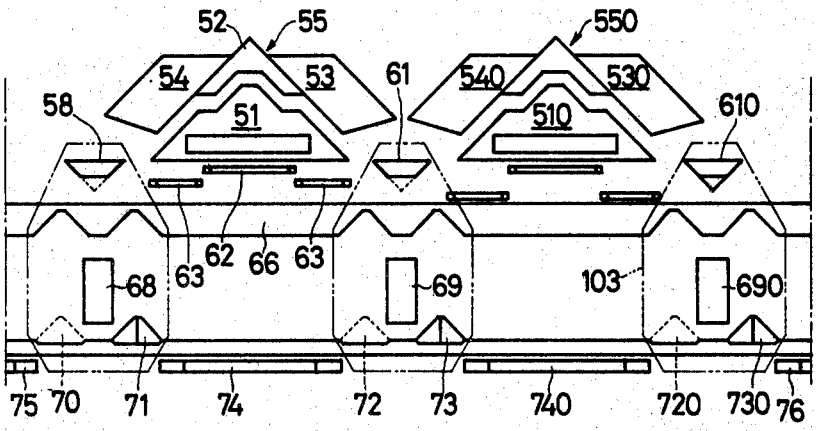
FIG. 3 is a plan view of the cam arrangement of a two-lock carriage, seen through a ground plate for cams.

The cam arrangement of a carriage having two locks is illustrated in FIG. 3. A second lock 550 is disposed on one side of a first lock 55. The second lock 550 comprises a clearing cam 510 and a knitting cams 530 and 540 and for this lock 550, a needle selecting member 103 comprising a select jack lowering cam 610, a needle selecting actuator 690 and selector push-up cams 720 and 730 is provided.

The method of the present invention will now be described.

In the case where the knitting operation is carried out by using the one-lock carriage as shown in FIG. 2, the carriage is shifted to the right (in the direction of arrow A), and when knitting is completed by the lock 55, the select jack butt 10 for the needle located at the tuck position of a height L1 and the select jack butt 10 located at the knit position of a height L2 butt against the select jack lowering cam 58 including the stationary cam 56 and movable cam 57. At this point, since the movable cam 57 projects, all the butting select jack butts 10 are pushed down by the movable cams 57 to the lower position of a height L3. Since the select jack butt 10 for the needle located at the welt position has been kept at the lower position L3, all the select jack butts 10 are thus located at the lower position L3. At this point, the needle selecting actuator 68 is operated based on the memory of the memory device (not shown), and selects selectors 6 corresponding to all the select jack 5 except the select jacks 5 for the needles which take the welt position at knitting of the subsequent course. This selection is performed by pushing of the needle selecting actuator 68 to the selector butt 14, and the selector 6, the selector butt 14 of which is not pushed, is lifted up because the butt 13 is caused to butt against the selector push-up cam 70 with the movement of the carriage in the direction A. By this rising of the selector 6, the selector jack 5 is brought up to locate the select jack butt 10 at the elevated position L1. Then, the butt 12 is caused to butt against the selector guide 66 and the selector 6 is pushed down. In the above-mentioned manner, the select jacks 5 are divided in two groups, that is, one group where the butt 10 is located at the upper position L1 (needles to be located at the knit and tuck positions at knitting of the subsequent course) and the other group where the butt 10 is located at the lower position L3 (needles to be located at the welt position at knitting of the subsequent course), by the movement of the carriage to the right (in the direction of arrow A) and the action of the needle selecting member 101, whereby preliminary needle selection is completed. On the right end of the knitting machine, the movement direction of the carriage is reversed and the carriage begins to move to the left (in the direction of arrow B).

While the carriage travels to the left (in the direction of arrow B), the movable cam 57 of the select jack lowering cam 58 is retracted, and all the select jack butts 10 located at the upper position L1 are brought down to the intermediate position L2 by the stationary cam 56 while the select jack butts 10 located at the lower position L3 are kept at this position L3. Simultaneously, the butt 13 of the selector 6 passes through an inclined face 80 of the selector push-up cam 70, and it does not make any vertical movement but confronts the needle selecting actuator 68. At this point, secondary selection is carried out. Among the select jack butts 10 located at the lower position L3 by preliminary needle selection, the selectors 6 corresponding to the select jack 5 of the needles to be located at the tuck position are selected by operating the needle selecting actuator 68 by the same means as in case of the preliminary needle selection. The selected selector 6 is lifted up by the selector push-up cam 71, and by this rising movement of the selector 6, the select jack 5 is raised up to locate the select jack butt 10 at the upper position L1.

While the carriage is travelling to the left (in the direction of arrow B), by the above-mentioned secondary needle selection, the select jacks 5 are divided and located at the upper position L1, the intermediate position L2 and the lower position L3, and the needles 3 corresponding to the respective select jacks 5 are operated by the lock 55 to effect the knitting operation.

The select jack butt 10 located at the lower position L3 is pressed by the select jack pressure cam 63, and the jack butt 7 of the jack 4 of the needle 3 corresponding to the select jack 10 is caused to sink in the needle groove 2. Accordingly, this jack butt 7 is not caused to butt against the clearing cam 51 of the lock 55 and is not lifted up at all. Namely, the needle 3 corresponding to this select jack butt 10 takes the welt position.

The select jack butt 10 located at the intermediate position L2 does not receive any action in the lock 55, and the jack butt 7 rises according to the clearing cam 51 and the needle 3 corresponding to this select jack butt 10 takes the knit position.

The select jack butt 10 located at the upper position L1 is pressed by the select jack pressure cam 62 in the central portion of the lock 55. Before this pressing, the butt 7 of the corresponding jack 4 has butted against the clearing cam 51 to raise up the needle 3. However, by this pressing, the jack butt 7 is caused to sink into the needle groove 2 until the jack butt 7 traverses the clearing cam 51, and therefore, the jack butt 7 does not butt against the clearing cam 51 in the vicinity of top of the clearing cam 51 but traverses the clearing cam 51 and butts against the knitting cam 53. Then, the jack butt 7 is brought down.

Subsequently, in the state where the movable cam 60 of the select jack lowering cam 61 is projected, all the select jack butts 10 located at the upper and intermediate positions L1 and L2 are brought down to the lower position L3, and the needle selecting actuator 69 is operated to preliminarily select needles to be located at the tuck and knit positions at knitting of the subsequent course among needles of the jack butts 10 located at the lower position L3, and the selectors 6 of the preliminary selected needles are raised to the upper position L1 by the selector push-up cam 73. Thus, the movement of the carriage to the left (in the direction of arrow B) is completed.

In the same manner as described above, the operations of the carriage, cams and needle selecting actuators are repeated.

Incidentally, when stitch transfer becomes necessary during the knitting operation, needles selected by the operation of the needle selecting actuator 68 or 69 are guided to the stitch transfer cams 77 and 78 disposed on both the sides of the lock 55 and the stitch transfer operation is carried out.

When the two-lock carriage is used, the needle selecting operations are conducted in the same manner as described above with respect to the one-lock carriage.

INDUSTRIAL APPLICABILITY

The method and apparatus of the present invention can be applied to formation of Jacquard pattern knitted fabrics and Intarsia knitted fabrics where arrangements and configurations of patterns are freely selected and manifested.

I claim:

1. A method for selecting needles in a flat knitting machine including a carriage and at least one lock, which comprises arranging needle selecting members on both the front and rear sides of the one lock in both directions of travel of the carriage, preliminarily selecting and dividing needles into two groups by a succeeding rear needle selecting member and further selecting and dividing one of said two groups divided by said preliminary needle selection, into two groups by a preceding front needle selecting member at the time of reversing of the moving direction of the carriage.

2. The method as set forth in claim 1, wherein the step of preliminarily selecting and dividing needles into two groups includes the step of moving the other of the two groups of needles into a lower, welt position.

3. The method as set forth in claim 1, wherein the further selecting and dividing one of said two groups of needles includes the step of moving all of the needles of the one of said two groups into a central knit position.

4. The method as set forth in claim 3, wherein the further selecting and dividing one of said two groups of needles also includes the step of moving some of the needles, moved into the central, knit position, into an upper, tuck position.

5. Structure for selecting needles in a flat knitting machine which knitting machine includes a needle bed a plurality of needles positioned on the bed and means also positioned on the bed operably associated with the needles for selectively positioning the needles in an upper tuck position, a central knit position or a lower welt position, a carriage positioned adjacent the needle bed for reciprocal movement across the needle bed and at least one lock on the carriage engageable with the means for positioning the needles to produce desired knitting thereby in accordance with the positioning of the needles comprising needle selecting members operably associated with the means for positioning the needles located on the carriage on both front and rear sides of the lock in both directions of travel of the carriage for preliminarily selecting and dividing the needles into two groups by a succeeding rear needle selecting member and means operably associated with the means for positioning the needles located on the carriage for further selecting and dividing one of said two groups divided by the preliminary needle selection and dividing into two groups, by a preceeding front needle selecting member at the time of reversing of the moving direction of the carriage.

6. Structure as set forth in claim 5, wherein the means for dividing the needles into two groups includes means for positioning all of the needles in a lower welt position.

7. Structure as set forth in claim 6, wherein the means for moving all of the needles into a lower welt position includes a jack lowering cam having a stationary cam portion and a movable cam portion.

8. Structure as set forth in claim 7, wherein the means for dividing the needles into two groups further includes a needle selecting actuator on the carriage for engaging the means for selectively positioning the needles on actuation thereof and a selector push-up cam on the carriage engageable with the means for selectively positioning the needles on movement of the carriage to move part of the needles from the welt position to a central knit position.

9. Structure as set forth in claim 5, wherein the means for further dividing one of the two groups of needles comprises means for moving the one of said two groups of needles into a central knit position.

10. Structure as set forth in claim 9, wherein the means for moving the one of the two groups into a central knit position includes a jack lowering cam having a fixed and a movable portion carried by the carriage.

11. Structure as set forth in claim 9, wherein the means for further dividing one of said two groups of needles further includes means for moving some of the needles from the central knitting position to an upper tuck position.

12. Structure as set forth in claim 11, wherein the means for moving some of the one group of needles to an upper tuck position comprises a needle selection actuator carried by the carriage and a selector push-up cam also carried by the carriage and engageable with the means for positioning the needles.

13. Structure as set forth in claim 5, and further including an additional lock and a further needle selecting member positioned aligned with the original lock and needle selecting members to provide needle selecting members on both sides of the additional lock.

* * * * *